US007789386B2

(12) United States Patent
Mizutani

(10) Patent No.: US 7,789,386 B2
(45) Date of Patent: Sep. 7, 2010

(54) SHEET TRANSPORTING APPARATUS

(75) Inventor: Naoki Mizutani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/292,535

(22) Filed: Nov. 20, 2008

(65) Prior Publication Data

US 2009/0140491 A1 Jun. 4, 2009

(30) Foreign Application Priority Data

Nov. 30, 2007 (JP) ..... 2007-310214
Jan. 9, 2008 (JP) ..... 2008-002622

(51) Int. Cl.
*B65H 5/06* (2006.01)

(52) U.S. Cl. ..... 271/272; 271/266

(58) Field of Classification Search ..... 271/10.13, 271/264, 272, 266

See application file for complete search history.

(56) References Cited

U.S. PATENT DOCUMENTS 5,140,364 A * 8/1992 Nakayama ..... 355/50
5,755,435 A * 5/1998 Fujiwara ..... 271/4.04
5,806,650 A * 9/1998 Mennie et al. ..... 194/206
6,062,557 A * 5/2000 Kusumi ..... 271/10.13

FOREIGN PATENT DOCUMENTS

JP 5-270694 10/1993

* cited by examiner

*Primary Examiner*—Kaitlin S Joerger
(74) *Attorney, Agent, or Firm*—Smith, Gambrell & Russell, LLP

(57) ABSTRACT

A sheet transporting apparatus that can realize a jam disposal mechanism with simple structure and that can achieve size reduction has a manual operation unit that is fitted coaxially with a roller shaft of an upstream-side transport roller or with a roller shaft of a downstream-side transport roller and that, when rotated in a state where drive motors are stationary, makes the upstream-side transport roller shaft and the downstream-side transport roller shaft rotate.

13 Claims, 8 Drawing Sheets

SHEET TRANSPORTING APPARATUS

This application is based on Japanese Patent Application No. 2007-310214 filed on Nov. 30, 2007 and Japanese Patent Application No. 2008-002622 filed on Jan. 9, 2008, and the contents of which are hereby incorporated by reference.

BACKGROUND OF THE INVENTION

1. Field of the Invention

The present invention relates to a sheet transporting apparatus, and more particularly to a sheet transporting apparatus that can realize a jam disposal mechanism with simple structure and that can thereby achieve space saving.

2. Description of Related Art

Conventionally, electrophotographic image forming apparatuses, such as printers, copiers, facsimile machines, and multifunctional machines with more than one of the functions of those, are furnished with a sheet transporting apparatus for transporting an original document or recording paper sheet, for example, through a part leading from a recording paper cassette or hand-feed tray to an image forming section, or through an image reading system for reading an original document to generate image data. Such a sheet transporting apparatus is, in particular in a large-size image forming apparatus, provided with an upstream-side transport roller (e.g., a pair of transport rollers 18 as shown in FIG. 1) at an upstream-side and a downstream-side transport roller (e.g., a pair of resist rollers 19 as shown in FIG. 1) at a downstream side, and rotates these upstream-side and downstream-side transport rollers with drive motors provided for them respectively.

For example, JP-A-5-270694 proposes this type of sheet transporting apparatus, which is provided with: drive motors corresponding to an upstream-side transport roller and a downstream-side transport roller respectively; an upstream-side rotation transmission system fitted to a roller shaft integral with the upstream-side transport roller; and a downstream-side rotation transmission system fitted to a roller shaft integral with the downstream-side transport roller. In this type of sheet transporting apparatus, during an image forming process or the like in an image forming apparatus in which the sheet transporting apparatus is incorporated, the upstream-side and downstream-side rotation transmission systems transmit the rotation of the drive motors to the upstream-side and downstream-side transport roller shafts.

This makes the upstream-side and downstream-side transport rollers rotate to transport the sheet to the downstream side. Moreover, the sheet transporting apparatus is furnished with a jam disposal rotation transmission system provided with a manual operation unit for allowing, when a sheet being transported gets stuck (i.e., when a jam occurs), removal of the jammed sheet in a state where the drive motors are stationary. Such a jam disposal rotation transmission system is coupled between the upstream-side and downstream-side rotation transmission systems, and, as the manual operation unit is rotated, the rotation thereof is transmitted to the upstream-side and downstream-side rotation transmission systems to make the upstream-side and downstream-side transport rollers rotate until a downstream-side tip portion of the sheet with respect to the transport direction is transported to a predetermined position.

However, in this type of sheet transporting apparatus, the manual operation unit is located in a space between the upstream-side and downstream-side rotation transmission systems. Inconveniently, this requires a mechanism for transmitting the rotation of the manual operation unit to the upstream-side and downstream-side rotation transmission systems, complicates the structure of the jam disposal rotation transmission system, and in addition increases the installation space needed.

SUMMARY OF THE INVENTION

The present invention has been made under the background discussed above, and it is an object of the present invention to provide a sheet transporting apparatus that can realize a jam disposal mechanism with simple structure and that can thereby achieve size reduction.

It is another object of the present invention to provide a sheet transporting apparatus that allows, when a sheet on the way of being transported is jammed, easy formation of a pickup part in the sheet between the upstream-side and downstream-side transport rollers and that thereby allows easy removal of a jammed sheet.

To achieve the above objects, according to the present invention, a sheet transporting apparatus that transports a sheet by rotating, with drive motors, an upstream-side transport roller provided at an upstream side with respect to a sheet transport direction and a downstream-side transport roller provided at a downstream side with respect to the sheet transport direction is provided with: a manual operation unit that is fitted coaxially with a roller shaft of the upstream-side or with a roller shaft of the downstream-side transport roller and that, when rotated in a state where the drive motors are stationary, makes the upstream-side transport roller shaft and the downstream-side transport roller shaft rotate.

In this sheet transporting apparatus, in a state where the drive motors are stationary, the manual operation unit allows the upstream-side or downstream-side transport roller shaft, which is coaxial with the manual operation unit, to rotate to make the upstream-side and downstream-side transport rollers rotate. Thus it is possible to structure the jam disposal mechanism with simple structure, and it is possible to thereby reduce the size of the sheet transporting apparatus.

According to the present invention, the sheet transporting apparatus described above may be further provided with a slide mechanism that allows the manual operation unit to slide in the axial direction of the upstream-side transport roller shaft or of the downstream-side transport roller shaft.

According to the present invention, in the sheet transporting apparatus described above, the slide mechanism may switch whether or not the rotation of the manual operation unit is transmitted to the roller shaft to which the manual operation unit is not fitted. This is to cope with a situation where the condition of a jammed sheet does not allow removal thereof unless only one of the upstream-side and downstream-side transport rollers is rotated.

According to the present invention, the sheet transporting apparatus described above may be further provided with an attaching/detaching unit that attaches and detaches, to and from an image carrying member on which an output image is formed, or to and from a transfer destination member onto which the output image on the image carrying member is transferred, a transfer unit that transfers the output image onto the sheet, so that, when the attaching/detaching unit detaches the transfer unit from the image carrying member or from the transfer destination member, the slide mechanism may make the manual operation unit slide in a direction away from the upstream-side and downstream-side transport rollers along the roller shafts thereof.

With this structure, the attaching/detaching unit and the slide mechanism operate in a coordinated manner so that, only when the transfer unit is detached from the image carrying member or from the transfer destination member, the manual operation unit can be operated. Thus, when a jammed sheet is transported by operation of the operation knob it is possible to prevent a tip portion of the sheet from making contact with the contact part (transfer nip part) between the image carrying member or the transfer destination member and the transfer unit. Thus it is possible to prevent damage to the image carrying member or to the transfer destination member.

Moreover, when the transfer unit is not detached from the image carrying member or the transfer destination member, the manual operation unit is at a position so slid in the axial direction as to be closer to the upstream-side or downstream-side transport roller. Thus it is possible to reduce the depth dimension of the sheet transporting apparatus.

According to the present invention, the sheet transporting apparatus described above may be further provided with a reverse rotation mechanism that, when the manual operation unit is rotated in the reverse direction, transmits the rotation thereof only to the downstream-side transport roller shaft to move the sheet to the upstream side. This is to cope with a situation where the condition of a jammed sheet allows removal thereof more easily if the sheet is transported to the upstream side with respect to the transport direction than to the downstream side.

According to the present invention, in the sheet transporting apparatus described above, between the manual operation unit and the upstream-side transport roller shaft or the downstream-side transport roller shaft, a one-way clutch may be interposed that transmits only rotation that moves the sheet in the downstream direction. This is to prevent, during normal sheet transport, even when the drive motors make the upstream-side and downstream-side transport rollers rotate in the downstream direction with respect to the transport direction, the rotation thereof from being transmitted to the manual operation unit.

According to the present invention, in the sheet transporting apparatus described above, the circumferential speed of the rotation of the upstream-side transport roller by the manual operation unit may be set to be higher than the circumferential speed of the rotation of the downstream-side transport roller.

According to the present invention, when the upstream-side and downstream-side transport rollers rotate in the transport downstream direction of the sheet, the upstream-side transport roller rotates with a circumferential speed higher than the circumferential speed of the rotation of the downstream-side transport roller. Thus the amount of transport by which a jammed sheet is transported in the transport downstream direction by the upstream-side transport roller is larger than the amount of transport by which it is transported in the transport downstream direction by the downstream-side transport roller. This causes the sheet to warp between the upstream-side and downstream-side transport rollers.

Thus, according to the present invention, in a sheet transporting apparatus provided with upstream-side and downstream-side transport rollers, when a sheet on the way of being transported gets stuck (when a so-called jam occurs), it is possible to form a pickup part in the sheet between the upstream-side and downstream-side transport rollers. Thus it is possible to remove a jammed sheet easily.

According to the present invention, in the sheet transporting apparatus described above, the manual operation unit may be composed of upstream-side and downstream-side rotating members structured with pulleys, and the difference between the circumferential speeds may be set by the ratio of the pulleys.

According to the present invention, in the sheet transporting apparatus described above, the manual operation unit may be composed of upstream-side and downstream-side rotating members structured with gears, and the difference between the circumferential speeds may be set by the ratio of the gears According to the present invention, in the sheet transporting apparatus described above, the diameter of the upstream-side transport roller may be set larger than the diameter of the downstream-side transport roller.

According to the present invention, in the sheet transporting apparatus described above, on a transport path between the upstream-side and downstream-side transport rollers, a hollow-space portion may be provided to allow removal of a sheet warped owing to the difference between the circumferential speeds.

According to the present invention, in a state where the drive motors are stationary, the manual operation unit makes the upstream-side or downstream-side transport roller shaft, which is coaxial with the manual operation unit, rotate to thereby make the upstream-side or downstream-side transport roller rotate. Thus it is possible to structure the jam disposal mechanism with simple structure, and thus it is possible to reduce the size of the sheet transporting apparatus. Moreover, according to the present invention, when the manual operation unit makes the upstream-side and downstream-side transport rollers in the transport downstream direction, the upstream-side transport roller rotates with a circumferential speed higher than the circumferential speed of the downstream-side transport roller. Thus the amount of transport in the transport downstream direction achieved by the upstream-side transport roller is larger than the amount of transport in the transport downstream direction achieved by the downstream-side transport roller. This causes the sheet to warp between the upstream-side and downstream-side transport rollers.

Thus, according to the present invention, in a sheet transporting apparatus provided with upstream-side and downstream-side transport rollers, when a sheet on the way of being transported gets stuck (when a so-called jam occurs), it is possible to form a pickup part in the jammed sheet between the upstream-side and downstream-side transport rollers, and thus it is possible to remove the sheet easily by way of the hollow-space portion provided on the transport path.

DETAILED DESCRIPTION OF PREFERRED EMBODIMENTS

Hereinafter, with reference to the accompanying drawings, embodiments of the present invention will be described for the understanding of the present invention. It is however to be understood that the embodiments described below are merely specific examples of how the present invention can be carried out and are not intended to limit the technical scope of the present invention.

Figure 1:
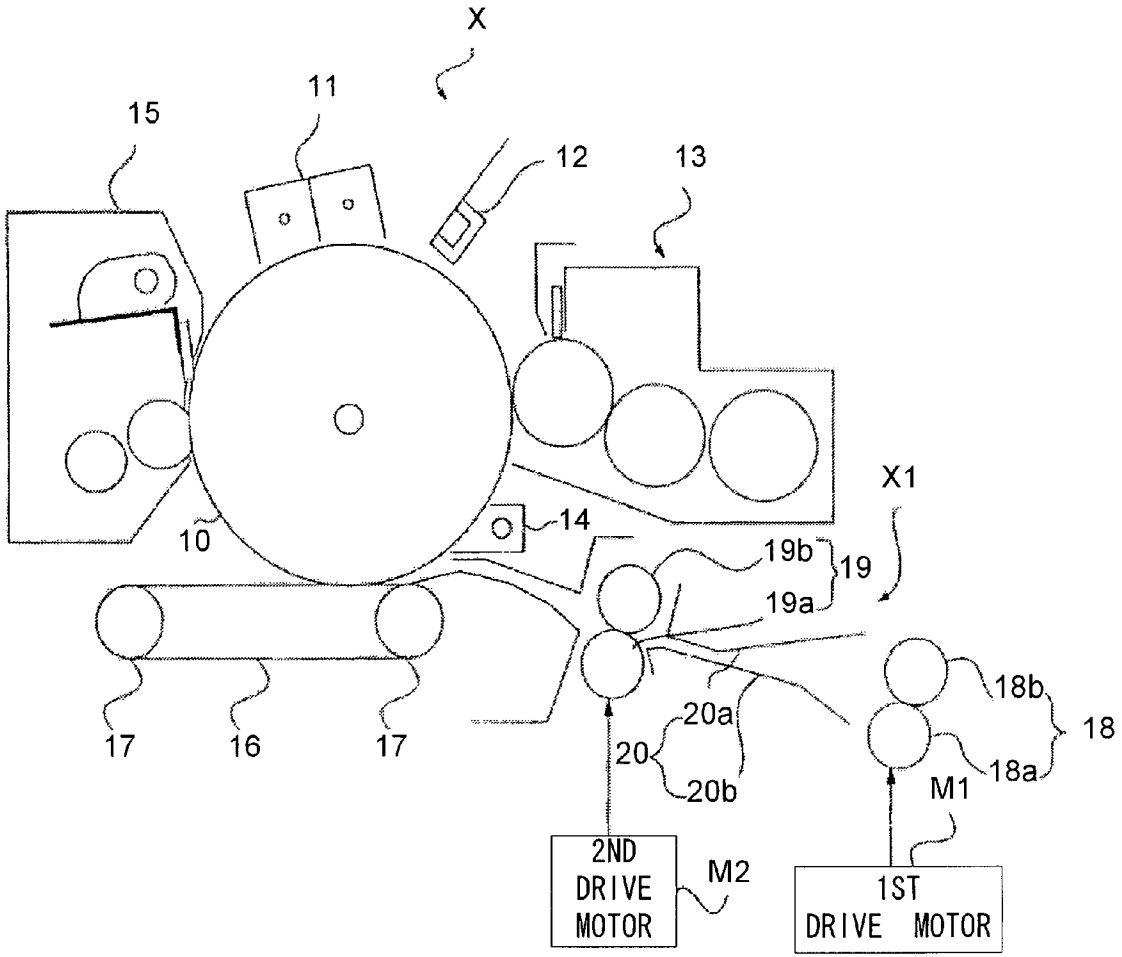
FIG. 1 is a sectional view to show a principal portion of an image forming section X including a sheet transporting apparatus X1 embodying the present invention.
Figure 2A:
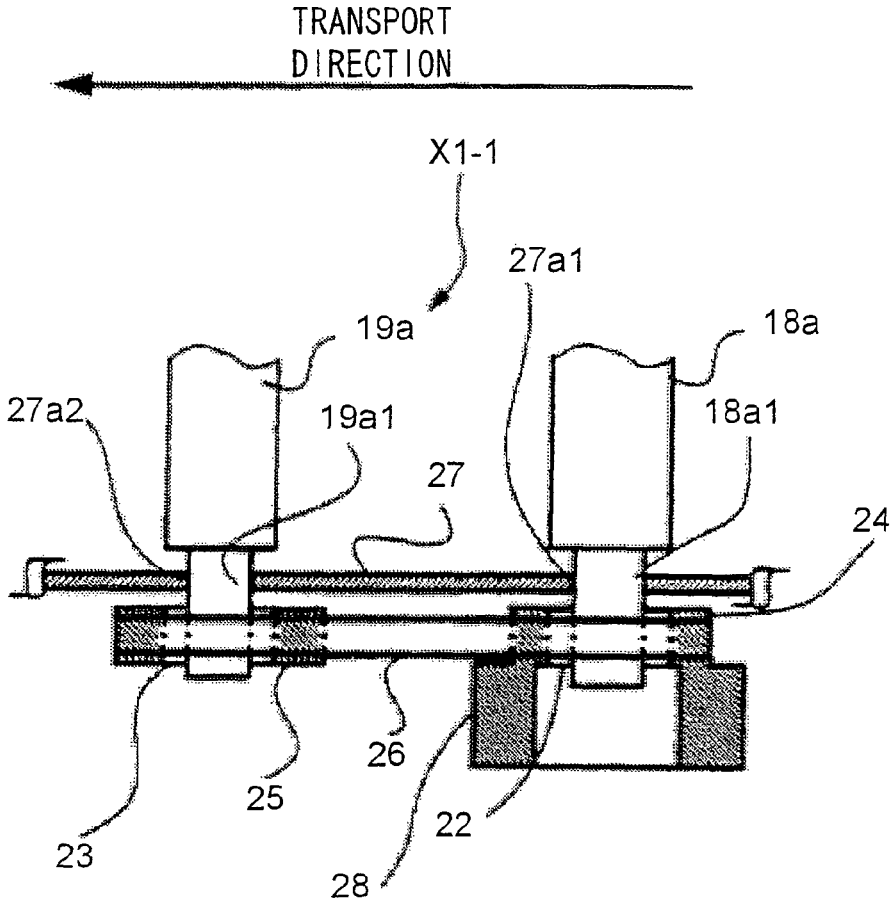
FIG. 2A is a schematic plan view of a sheet transporting apparatus X1-1 according to a first embodiment of the invention, with the follow rollers 18*b* and 19*b* omitted from illustration.
Figure 2B:
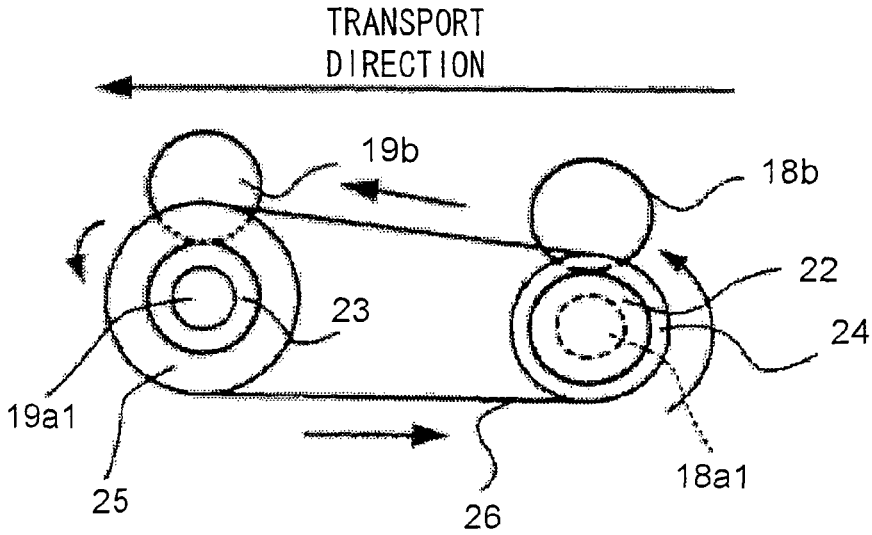
FIG. 2B is a schematic side view of the same, with the operation knob 28 (an example of manual operation unit) shown in FIG. 2A omitted from illustration.
Figure 3A:
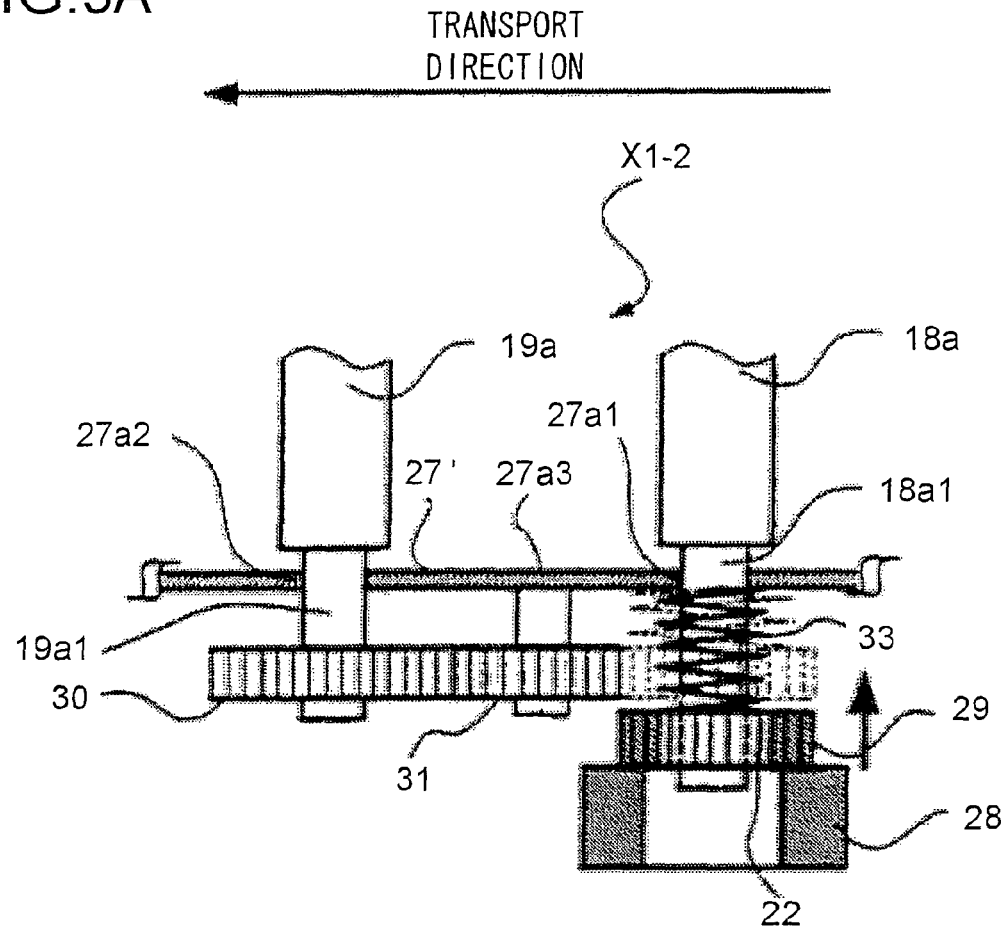
FIG. 3A is a schematic plan view of a sheet transporting apparatus X1-2 according to a second embodiment of the invention, with the follow rollers 18*b* and 19*b* omitted from illustration.
Figure 3B:
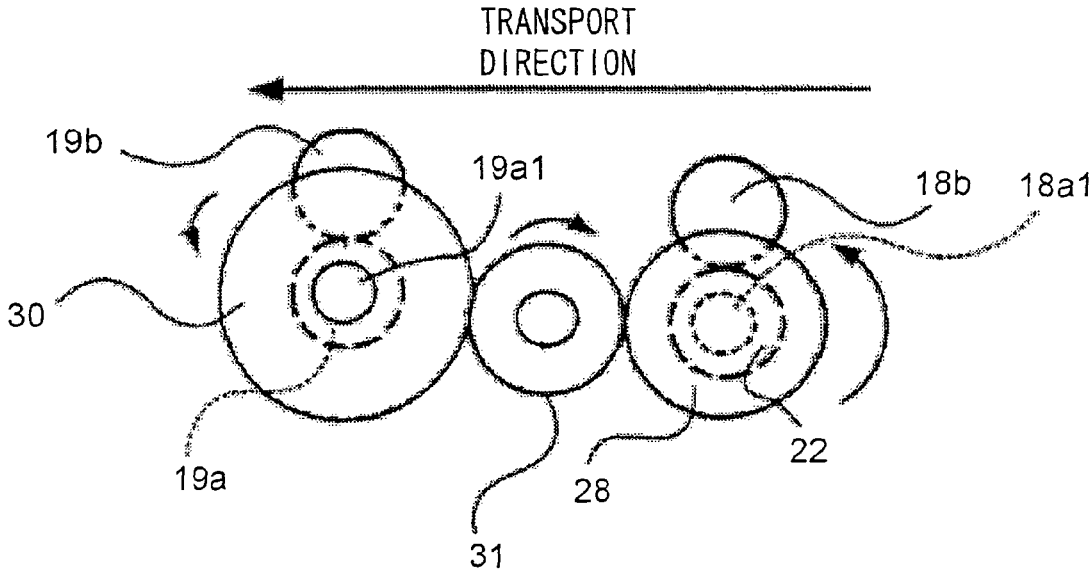
FIG. 3B is a schematic side view of the same, with the operation knob 28 (an example of a manual operation unit) shown in FIG. 3A omitted from illustration.
Figure 4A:
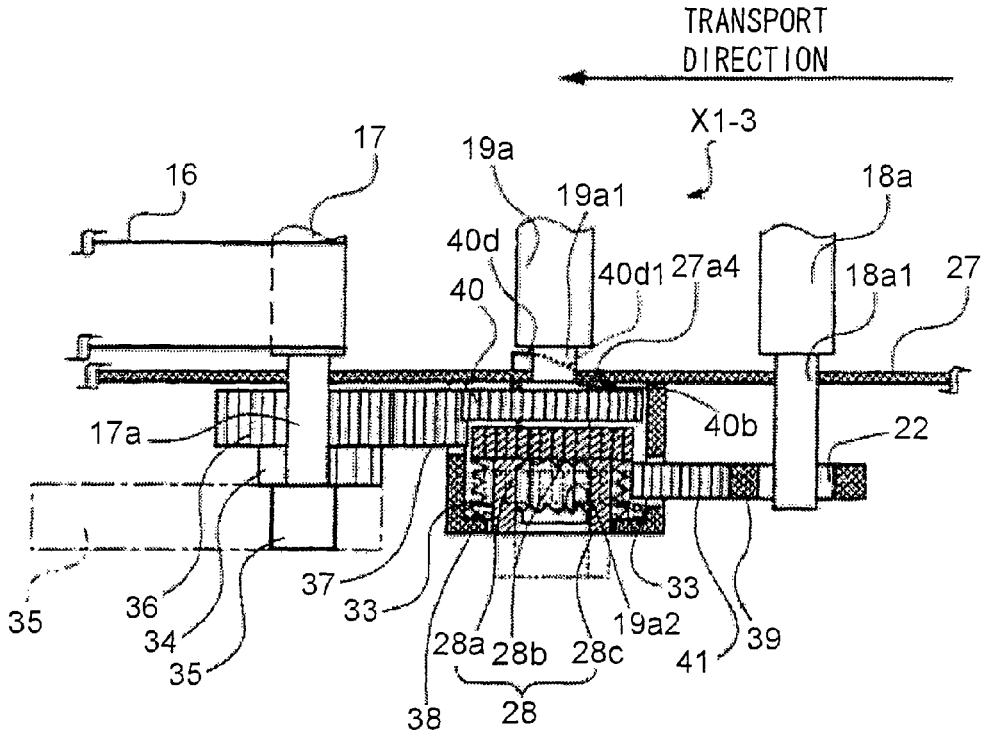
FIG. 4A is a schematic plan view of a sheet transporting apparatus X1-3 along with peripheral members of the transfer belt rotating roller 17, with the follow rollers 18*b* and 19*b* omitted from illustration.
Figure 4B:
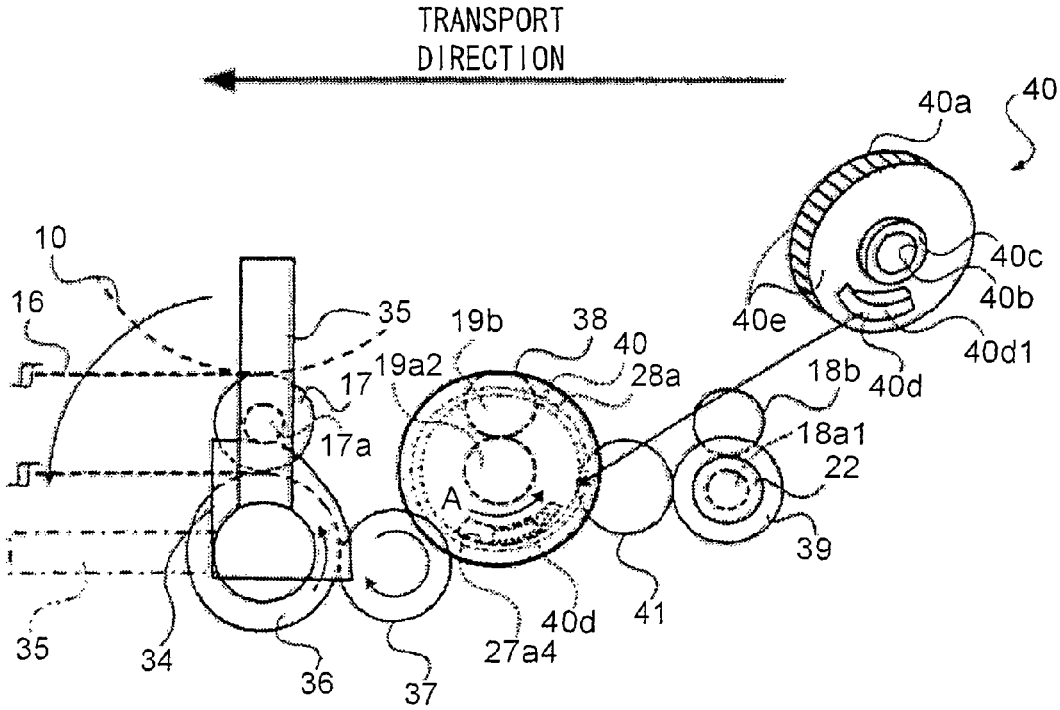
FIG. 4B is a schematic side view of the same.

FIG. 1 is a sectional view to show a principal portion of an image forming section X including a sheet transporting apparatus X1 embodying the present invention; FIGS. 2A and 2B are a schematic plan view and a schematic side view, respectively, of a sheet transporting apparatus X1-1 according to a first embodiment of the invention; FIGS. 3A and 3B are a schematic plan view and a schematic side view, respectively, of a sheet transporting apparatus X1-2 according to a second embodiment of the invention; and FIGS. 4A and 4B are a schematic plan view and a schematic side view, respectively, of a sheet transporting apparatus X1-3 according to a third embodiment of the invention, along with peripheral members of the transfer belt rotating roller 17.

First, with reference to FIG. 1, the structure of an image forming section X including a sheet transporting apparatus X1 embodying the present invention will be described. The image forming section X shown in FIG. 1 is incorporated in an electrophotographic image forming apparatus, such as a printer, a copier, a facsimile machine, or a multifunctional machine with more than one of the functions of those.

As shown in FIG. 1, the image forming section X is structured with: a photoconductive drum 10 (an example of an image carrying member) that carries a toner image on a surface thereof; a charging portion 11 that electrically charges the surface of the photoconductive drum 10 uniformly; an exposure portion 12 that irradiates the surface of the photoconductive drum 10 with laser light to expose the surface to the laser light, in order to thereby write an electrostatic latent image thereon; a development portion 13 that supplies toner (an example of a developer) to the electrostatic latent image to thereby develop it as a toner image; a density detection portion 14 that detects the density of the toner image developed by the development portion 13; a cleaning portion 15 that removes the toner image developed on the surface of the photoconductive drum 10; and a transfer belt 16 (an example of a transfer destination member) that is wound around and between transfer belt rotating roller 17 (an example of a transfer unit) and is driven to rotate by the transfer belt rotating roller 17 to transport recording paper (an example of a sheet) transported from the sheet transporting apparatus X1 to allow the toner image formed on the surface of the photoconductive drum 10 to be transferred onto the recording paper.

The sheet transporting apparatus X1 of this embodiment functions as a recording paper transport system provided in a part leading from an unillustrated recording paper cassette or hand-feed tray to the image forming section X. It is however to be understood that such a sheet transporting apparatus X1 finds application, not only as such a recording paper transport system, as various sheet transport systems for transporting an original document or recording paper sheet, such as: an image reading system for reading an original document (an example of a sheet) to generate image data; an original document reversing system for reversing an original document of which the obverse side has been read by an image reading system and then transporting the original document back to the image reading system to allow the image reading system to read both sides of the original document to generate image data; and a recording paper reversing system for reversing a recording paper (an example of a sheet) of which the obverse side has been developed by the image forming section X and then transporting the recording paper back to the image forming section X.

In the sheet transporting apparatus X1 according to this embodiment, recording paper transported from an unillustrated recording paper cassette or hand-feed tray is first transported by a pair of transport rollers 18 (an example of an upstream-side transport roller), which is composed of a drive roller 18*a* that rotates by receiving transmission of rotation of a drive motor M1 and a follow roller 18*b* that rotates by being in contact with the drive roller 18*a*; the recording paper is then further transported by the pair of transport rollers 18 to pass between transport guides 20 arranged opposite each other in the up/down direction so as to form a tapered passage. Thereafter, the recording paper is fed to a pair of resist rollers 19 (an example of a downstream-side transport roller), which is composed of a drive roller 19*a* that rotates by receiving transmission of rotation of a drive motor M2 and a follow roller 19*b* that rotates by being in contact with the drive roller 19*a*.

Here, the transport guides 20 have an upper transport guide 20*a* and a lower transport guide 20*b* arranged in a tapered shape with respect to the transport direction of the recording paper to form a tapered passage. Together the upper transport guide 20*a* and the lower transport guide 20*b* direct the recording paper transported by the pair of transport rollers 18 to the pair of resist rollers 19.

Then the pair of resist rollers 19 further transports the recording paper fed thereto through the transport guides 20 further to the contact part (transfer nip part) between the surface of the photoconductive drum 10 and the transfer belt 16 in synchronism with development of a toner image on the surface of the photoconductive drum 10.

Below will be described in detail, as specific examples of the sheet transporting apparatus X1 of this embodiment, a sheet transporting apparatus X1-1 according to a first embodiment, a sheet transporting apparatus X1-2 according to a second embodiment, and a sheet transporting apparatus X1-3 according to a third embodiment one by one. It is to be noted that, in the following description of the first to third embodiments, the term "upstream side" denotes "upstream side with respect to the transport direction of the sheet", and the term "downstream side" denotes "downstream side with respect to the transport direction of the sheet". It is also to be noted that, in the following description, "to rotate in such a way as to move a sheet in the upstream direction" is expressed simply as "to rotate in the upstream direction".

First Embodiment

First, the sheet transporting apparatus X1-1 will be described with reference to FIGS. 2A and 2B. FIG. 2A is a schematic plan view of the sheet transporting apparatus X, with the follow rollers 18*b* and 19*b* omitted from illustration, and FIG. 2B is a schematic side view of the sheet transporting apparatus X1-1, with the operation knob 28 (an example of a manual operation unit) shown in FIG. 2A omitted from illustration. In the sheet transporting apparatus X1-1, a shaft 18*a*1 (an example of an upstream-side transport roller shaft) of the drive roller 18*a* is rotatably mounted, via an unillustrated bearing, on a shaft support portion 27*a*1 provided in a side plate 27 integral with an unillustrated chassis. The upstream-side drive roller shaft 18*a*1 is fitted with, coaxially therewith and via a one-way clutch 22, an operation knob 28 integral with a pulley 24. The operation knob 28 may instead be fitted coaxially with a downstream-side drive roller shaft 19*a*1 (an example of a downstream-side transport roller shaft).

On the other hand, in the sheet transporting apparatus X1-1, the downstream-side drive roller 19*a*1 is rotatably mounted, via an unillustrated bearing, on a shaft support portion 27*a*2 provided in the side plate 27. The downstream-side drive roller shaft 19*a*1 is fitted with a pulley 25 coaxially therewith and via a one-way clutch 23. A pulley belt 26 is wound around and between the pulleys 24 and 25.

In the sheet transporting apparatus X1-1, when the drive motors M1 and M2 are stationary, separately provided clutches or the like decouple the pair of transport rollers 18 and the pair of resist rollers 19 from the drive motors M1 and M2, and thereby allow the pair of transport rollers 18 and the pair of resist rollers 19 to rotate freely. In this state, when the operation knob 28 is rotated in such a way that the pulley 24, which is integral with the operation knob 28, and the pulley 25, which is coupled to the pulley 24 by the pulley belt 26, are both rotated in the transport downstream direction of the sheet (in FIG. 2B, in the counter-clockwise direction), the one-way clutches 22 and 23 transmit only the rotation of the pulleys 24 and 25 in the transport downstream direction to the upstream-side and downstream-side drive roller shafts 18*a*1 and 19*a*1, and thereby make the pair of transport rollers 18 and the pair of resist rollers 19 rotate in the transport downstream direction. The one-way clutches 22 and 23 thus transmit rotation only in one direction; thus, during image formation, to prevent the rotation of the pair of transport rollers 18 and the pair of resist rollers 19 in the transport downstream direction from being transmitted to the operation knob 28, when the pulleys 24 and 25 are rotated in the reverse direction, that is, in the upstream direction with respect to the transport direction of the sheet (in FIG. 2B, in the clockwise direction), the rotation thereof is not transmitted to the upstream-side and downstream-side drive roller shafts 18*a*1 and 19*a*1, but the pulleys 24 and 25 rotate idly.

Specifically, in the sheet transporting apparatus X1-1, when a sheet is transported as a result of the drive motor M1 driving the upstream-side drive roller shaft 18*a*1 to rotate and the drive motor M2 driving the downstream-side drive roller shaft 19*a*1 to rotate, owing to the interposition of the one-way clutches 22 and 23, the pulleys 24 and 25 rotate idly around the upstream-side and downstream-side drive roller shafts 18*a*1 and 19*a*1. This prevents the operation knob 28 from rotating, and in addition reduces the loads on the drive motors M1 and M2.

On the other hand, in a state where the drive motors M1 and M2 are stationary, when the operation knob 28, which is fitted coaxially with the upstream-side or downstream-side drive roller shaft 18*a*1 or 19*a*1, is rotated in the transport downstream direction of the sheet as described above, the upstream-side and downstream-side drive roller shafts 18*a*1 and 19*a*1 rotate simultaneously owing to the pulley belt 26 wound around and between the pulleys 24 and 25. This makes it possible to remove a jam occurring in the sheet transporting apparatus X1.

With the structure described above, when at least the operation knob 28 fitted coaxially with the upstream-side or downstream-side drive roller shaft 18*a*1 or 19*a*1 is rotated, the upstream-side or downstream-side drive roller shaft 18*a*1 or 19*a*1 rotates. Thus it is possible to realize a jam disposal mechanism with simple structure provided with an operation knob 28 fitted coaxially with the upstream-side or downstream-side drive roller shaft 18*a*1 or 19*a*1, and to achieve size reduction of the sheet transporting apparatus X1.

Second Embodiment

Next, the sheet transporting apparatus X1-2 will be described with reference to FIGS. 3A and 3B. FIG. 3A is a schematic plan view of the sheet transporting apparatus X1-2, with the follow rollers 18*b* and 19*b* omitted from illustration, and FIG. 3B is a schematic side view of the same with the operation knob 28 (an example of a manual operation unit) shown in FIG. 3A omitted from illustration. It is to be noted that such members as are found also in the sheet transporting apparatus X1-1 shown in FIGS. 2A and 2B are identified by common reference signs, and no description thereof will be repeated.

In the sheet transporting apparatus X1-2, during normal sheet transport (otherwise than during jam disposal), an operation knob 28 slidably fitted to the upstream-side drive roller shaft 18*a*1 of the drive roller 18*a* is constantly biased in a direction perpendicular to the side plate 27 and in a direction away from the side plate 27 by an elastic member such as a spring 33 (an example of a slide mechanism). Thus, during normal sheet transport, a gear 29 integral with the operation knob 28 is in a state not meshed with an idle gear 31 (indicated by solid lines in FIG. 3A).

In this structure, during normal sheet transfer, the drive motor M1 drives the upstream-side drive roller shaft 18*a*1 to rotate, and in addition the drive motor M2 drives the downstream-side drive roller shaft 19*a*1 to rotate. Even in a state where, by being driven by those drive motors M1 and M2, the upstream-side and downstream-side drive roller shafts 18*a*1 and 19*a*1 are rotating, during normal sheet transfer, as indicated by solid lines in FIG. 3A, the gear 29 integral with the operation knob 28 is in a state not meshed with the idle gear 31; thus, even when the upstream-side drive roller shaft 18*a*1 rotates and thus the operation knob 28 rotates, the rotation thereof is not transmitted to the downstream-side drive roller shaft 19*a*1 to which the operation knob 28 is not fitted. Accordingly, there is no need for a one-way clutch 23 as provided between the downstream-side drive roller shaft 19*a*1 and the pulley 25 in the sheet transporting apparatus X1-1. This makes it possible to achieve cost reduction, and also to reduce the load on the drive motor M1.

On the other hand, during jam disposal, when, in a state where the drive motors M1 and M2 are stationary, the operation knob 28 is pushed in toward the side plate 27, the gear 29 integral with the operation knob 28 moves toward the side plate 27 against the biasing by the spring 33 and meshes with the idle gear 31 (indicated by broken lines in FIG. 3A). When, in this state, the operation knob 28 is rotated in the downstream direction (in FIG. 3B, in the counter-clockwise direction), the gear 29 rotates together in the same direction. Then the idle gear 31 rotates in the opposite direction (in FIG. 3B, in the clockwise direction) and transmits the rotation of the gear 29 to a gear 30; thus the gear 30, together with the gear 29, rotates in the downstream direction of the gears 29 and 30 (in FIG. 3B, in the counter-clockwise direction).

As a result, when the operation knob 28 is rotated in the downstream direction, the pair of transport rollers 18 and the pair of resist rollers 19 rotate in the downstream direction of the pair of transport rollers 18 and the pair of resist rollers 19. By contrast, when the operation knob, while it is in a state pushed in toward the side plate 27, is rotated in the direction reverse to the transport direction, although the operation knob 28 rotates idly owing to the one-way clutch 22, the rotation of the operation knob 28 is transmitted via the idle gear 31 and the gear 30 to the downstream-side drive roller shaft 19*a*1, and this makes it possible to rotate only the downstream-side drive roller shaft 19*a*1 in the direction reverse to the transport direction.

Thus, in this embodiment, a reverse rotation mechanism according to the present invention is realized with the one-way clutch 22, the gear 30, and the idle gear 31. Thus it is possible to make a sheet warp and form a pickup part therein between the pair of transport rollers 18 and the pair of resist rollers 19, and thus it is possible to hold the pickup part and remove the sheet easily.

Third Embodiment

Next, the sheet transporting apparatus X1-3 will be described with reference to FIGS. 4A and 4B. FIG. 4A is a schematic plan view of the sheet transporting apparatus X1-3 along with peripheral members of the transfer belt rotating roller 17, with the follow rollers 18*b* and 19*b* omitted from illustration, and FIG. 4B is a schematic side view of the sheet transporting apparatus X1-3 shown in FIG. 4A. It is to be noted that such members as are found also in the sheet transporting apparatuses X1-1 and X1-2 are identified by common reference signs, and no description thereof will be repeated.

In the sheet transporting apparatus X1-3, an operation knob 28 (an example of a manual operation unit) is slidably fitted coaxially with the downstream-side drive roller shaft 19*a*1. When the photoconductive drum 10 and the transfer belt rotating roller 17 are in contact with each other on the downstream side relative to the downstream-side drive roller shaft 19*a*1, the operation knob 28 is kept housed inside a protection cover 38 by being constantly biased toward the side face 27 by an elastic member such as a spring 33. In this state, the operation knob 28 is in a state disconnected from the drive roller 19*a* and an idle gear 41.

Moreover, a gear 39 is fitted coaxially with the upstream-side drive roller shaft 18*a*1, with the one-way clutch 22 interposed therebetween. Furthermore, on the downstream side relative to the downstream-side drive roller shaft 19*a*1, an operation knob release lever 35 is provided. When the operation knob release lever 35 is rotated in the downstream direction (in FIG. 4B, in the counter-clockwise direction), as it rotates, a cam 34 rotates together in the same direction, and as a result the shafts of the transfer belt rotating roller 17 supported by the cam 34 via an unillustrated bearing drop. When the operation knob release lever 35 is moved to the position shown in a phantom outline indicated by dash-and-dot lines, the photoconductive drum 10 and the transfer belt rotating roller 17 come apart from each other.

Moreover, when the operation knob release lever 35 is rotated in the downstream direction, as it rotates, a gear 36 rotates together in the same direction, and, owing to a slide mechanism described later, the operation knob 28 moves in the axial direction of the downstream-side drive roller shaft 19*a*1 against the biasing of the spring 33, and pops out of the protection cover 38. At this time, the operation knob 28 becomes coupled with the downstream-side drive roller shaft 19*a*1 and with the gear 39 (indicated by dash-dot-dot lines in FIG. 4A).

In this sheet transporting apparatus X1-3, during normal sheet transfer, the drive motor M1 drives the upstream-side drive roller shaft 18*a*1 to rotate, and in addition the drive motor M2 drives the downstream-side drive roller shaft 19*a*1 to rotate. Meanwhile, the operation knob 28, since it is kept disconnected from the downstream-side drive roller shaft 19*a*1, rotates idly; the gear 39, since the one-way clutch 22 is interposed between it and the upstream-side drive roller shaft 18*a*1, rotates idly. This makes it possible to reduce the loads on the drive motors M1 and M2.

On the other hand, during jam disposal, in a state where the drive motors M1 and M2 are stationary, the operation knob release lever 35 is rotated to the position shown in a phantom outline indicated with dash-and-dot lines as described above, so that the photoconductive drum 10 and the transfer belt rotating roller 17 are taken apart from each other, and in addition the operation knob 28 becomes meshed with the downstream-side drive roller shaft 19*a*1 and with the gear 39.

By contrast, when the operation knob release lever 35 is rotated to the original position indicated by solid lines, as it rotates, the cam 34 rotates in the upstream direction of the cam 34 (in FIG. 4B, in the clockwise direction), and the rotation thereof makes the transfer belt rotating roller 17 move in a direction in which they make contact with the photoconductive drum 10.

Moreover, as the cam 34 rotates, the gear 36 rotates in the upstream direction; as a result, an operation knob release gear 40 rotates in the upstream direction, and the operation knob 28 returns to the original position indicated by solid lines. Thus, in the sheet transporting apparatus X1 according to this embodiment, an attaching/detaching unit according to the present invention is realized with the cam 34 and the operation knob release lever 35, and a slide mechanism according to the present invention is realized with a structure described later; the attaching/detaching unit and the slide mechanism operate in a coordinated manner to realize the effects described above.

Here, to allow coupling between the downstream-side drive roller shaft 19*a*1 and the operation knob 28, these are structured as described below. The operation knob 28 is fitted around the downstream-side drive roller shaft 19*a*1, and is composed mainly of a gear portion 28*a* and a knob portion 28*c*, the gear portion 28*a* having, on the side thereof reverse to (in FIG. 4A, in the downward direction) the side thereof opposite the side plate 27, a meshing surface 28*b* having a plurality of claws formed thereon. On the other hand, in a tip portion of the downstream-side drive roller shaft 19*a*1, a meshing tip portion 19*a*2 having a plurality of claws formed in a circumferential portion thereof is fixed opposite the meshing surface 28*b*.

In the sheet transporting apparatus X1 according to this embodiment, owing to the downstream-side drive roller shaft 19*a*1 and the operation knob 28 structured as described above, the meshing tip portion 19*a*2 of the downstream-side drive roller shaft 19*a*1 and the meshing surface 28*b* of the operation knob 28 mesh with each other and transmit the rotation of the operation knob 28 to the downstream-side drive roller shaft 19*a*1. In a state where the operation knob 28 is coupled with the downstream-side drive roller shaft 19*a*1 and with the gear 39, when the operation knob 28 is rotated in the downstream direction of the operation knob 28 (in FIG. 4B, in the counter-clockwise direction), the rotation thereof is transmitted to the downstream-side drive roller shaft 19*a*1, and the downstream-side drive roller shaft 19*a*1 rotates in the downstream direction (in FIG. 4B, in the counter-clockwise direction).

Simultaneously, the rotation of the operation knob 28 is transmitted also to the idle gear 41, and the rotation of the idle gear 41 is transmitted to the gear 39, so that the gear 39 rotates in the downstream direction of the gear 39 (in FIG. 4B, the counter-clockwise direction). Thus, when the operation knob 28 is rotated in the downstream direction (in FIG. 4B, in the counter-clockwise direction), the pair of transport rollers 18 and the pair of resist rollers 19 rotate in the downstream direction (in FIG. 4B, in the counter-clockwise direction).

By contrast, when, in a state where the operation knob 28 is coupled with the downstream-side drive roller shaft 19*a*1 and with the gear 39, the operation knob 28 is rotated in the reverse direction (i.e., in the upstream direction of the operation knob 28), the rotation thereof is transmitted to the downstream-side drive roller shaft 19*a*1 and to the gear 39, but, owing to the function of the one-way clutch 22, is not transmitted to the upstream-side drive roller shaft 18*a*1. Thus, in the sheet transporting apparatus X1 of this embodiment, a reverse rotation mechanism is composed mainly with the one-way clutch 22, the meshing tip portion 19*a*2, and the meshing surface 28*b*. Thus, by rotating the operation knob 28 in the reverse direction, and thereby rotating only the downstream-side drive roller shaft 19*a*1 in the upstream direction thereof, it is possible to make the sheet warp between the pair of transport rollers 18 and the pair of resist rollers 19 and remove the sheet.

Here, a slide mechanism is realized with a projection insertion hole 27*a*4—provided in the side plate 27 and so sized and shaped as to correspond to a projection 40*d* described later—, the spring 33, the gear 36, an idle gear 37, and the operation knob release gear 40. The operation knob release gear 40 is composed mainly of: a gear portion 40*a* formed on a circumferential wall portion of the operation knob release gear 40; an insertion hole 40*b* having a diameter corresponding to the diameter of the downstream-side drive roller shaft 19*a*1; an upright wall 40*c* covering an outer circumference of the insertion hole 40*b* and upright in a direction perpendicular to a side portion 40*e*; and a projection 40*d*.

The upright wall 40*c* is provided not only on the illustrated side portion 40*e* but also on the side portion 40*e* reverse thereto; an end face of the upright wall 40*c* on one side portion 40*e* makes contact with the side plate 27, and an end face of the upright wall 40*c* on the other side portion 40*e* makes contact with the operation knob 28. The projection 40*d* is formed parallel to the circumferential direction of the side portion 40*e*, and is provided with a slanted portion 40*d*1 that is, as measured in a direction perpendicular to the side portion 40*e*, increasingly high from one end (an upstream-side end portion of the projection 40*d*) to the other end (a downstream-side end portion of the projection 40*d*).

The projection 40*d* is inserted in the projection insertion hole 27*a*4, and, as the operation knob release gear 40 rotates in the downstream direction thereof, the projection 40*d* rotates together in the direction of arrow A. Accordingly, the slanted portion 40*d*1 moves in the direction of arrow A while in contact with the inner circumferential wall surface of the projection insertion hole 27*a*4, with the result that, eventually, the slanted portion 40*d*1 moves out of the projection insertion hole 27*a*4 and runs onto the side face of the side plate 27. Thus the operation knob 28 is pushed out against the biasing by a spring 33 described later.

By contrast, when the operation knob release gear 40 rotates in the upstream direction thereof, the slanted portion 40*d*1 moves in the direction reverse to arrow A, and thus the projection 40*d* moves into the projection insertion hole 27*a*4.

Coordinated operation of the slide mechanism structured as described above with the attaching/detaching unit achieves the effects described above. Thus, during normal sheet transfer, the operation knob 28 is in a state housed inside the protection cover 38; only during jam disposal, the operation knob 28 is pushed out of the protection cover 38 to be ready to be operated. This makes it possible to give the sheet transporting apparatus X1 a compact size.

Moreover, since the attaching/detaching unit allows jam disposal using the operation knob 28 when the transfer belt rotating roller 17 are taken apart from the photoconductive drum 10, it is possible to prevent damage to the photoconductive drum 10 or to the transfer belt 16 resulting from a downstream-side tip portion of a jammed sheet making contact with the transfer nip portion.

Figure 5:
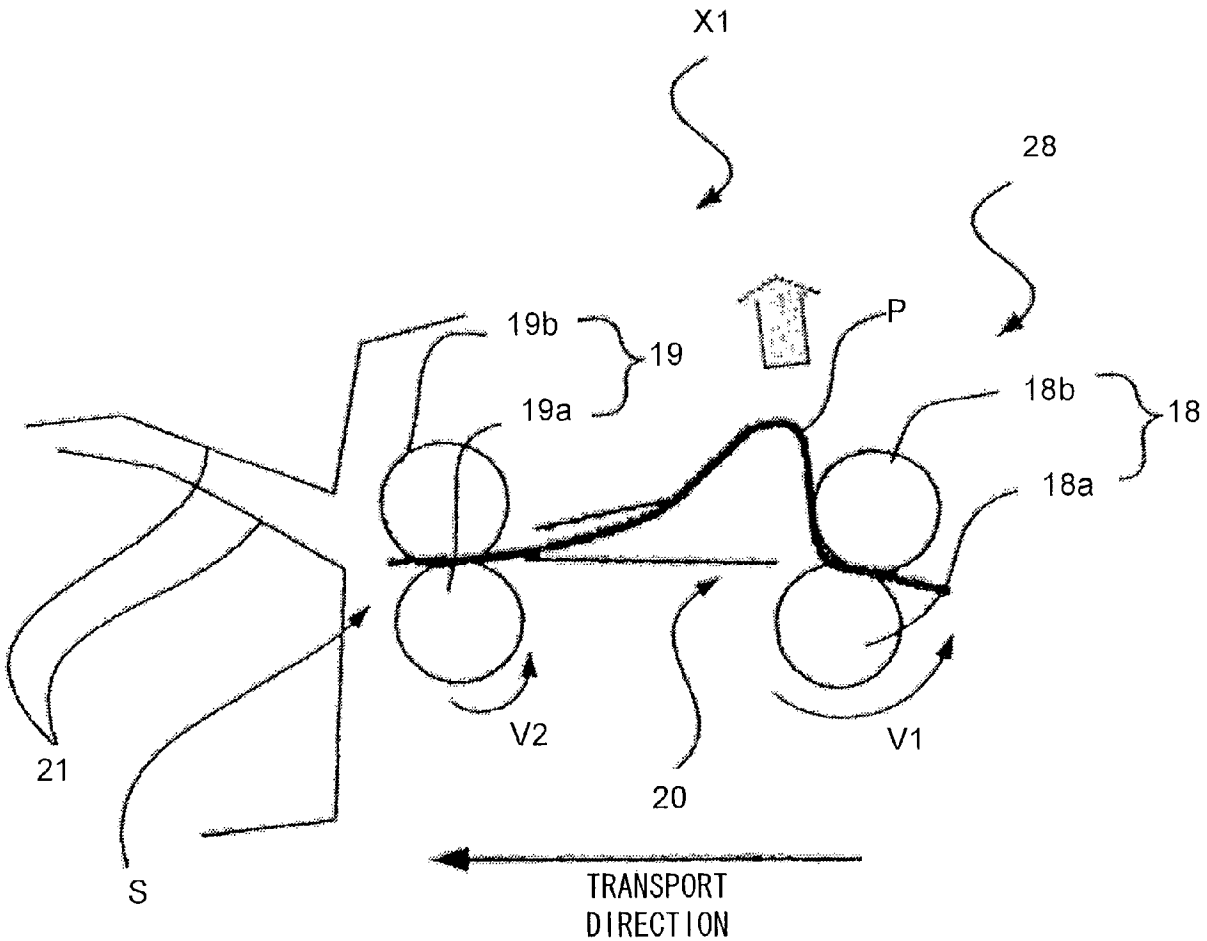
FIG. 5 is a schematic side view in illustration of the workings and benefits of a sheet transporting apparatus X1 embodying the present invention.
Figure 6A:
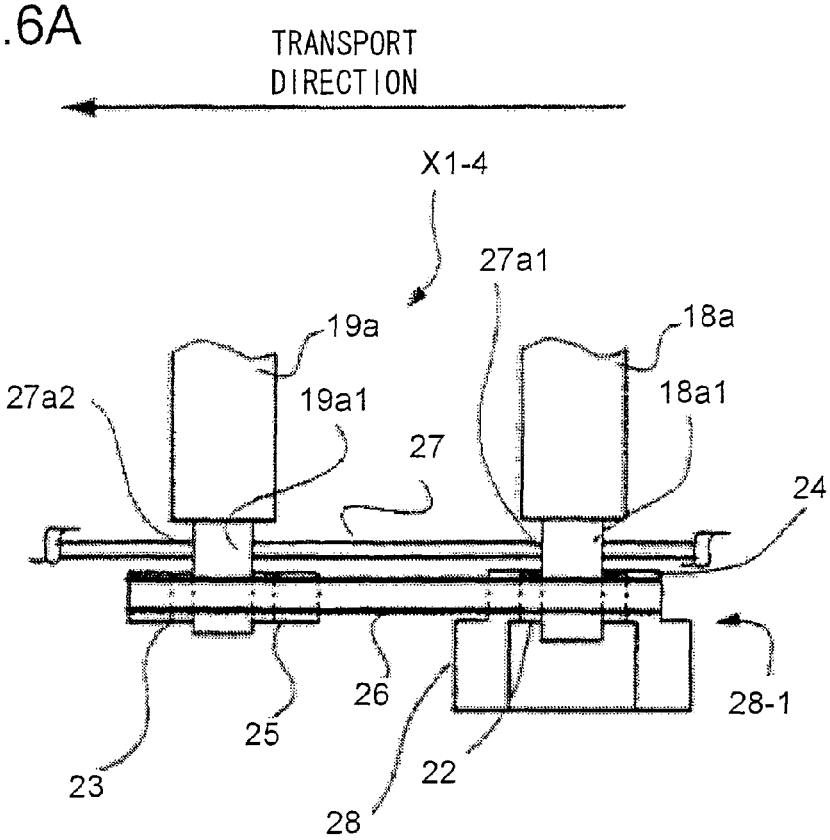
FIG. 6A is a schematic plan view of a sheet transporting apparatus X1-4, with the follow rollers 18*b* and 19*b* omitted from illustration.
Figure 6B:
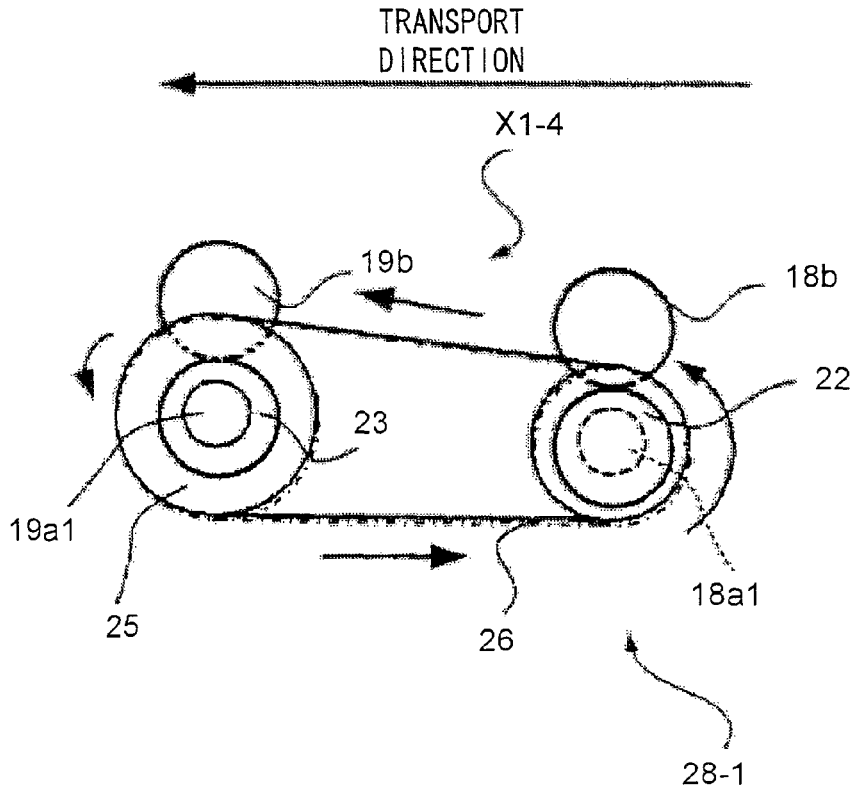
FIG. 6B is a schematic side view of the same, with the operation knob 28 (an example of a manual operation member) shown in FIG. 6A omitted from illustration.
Figure 7A:
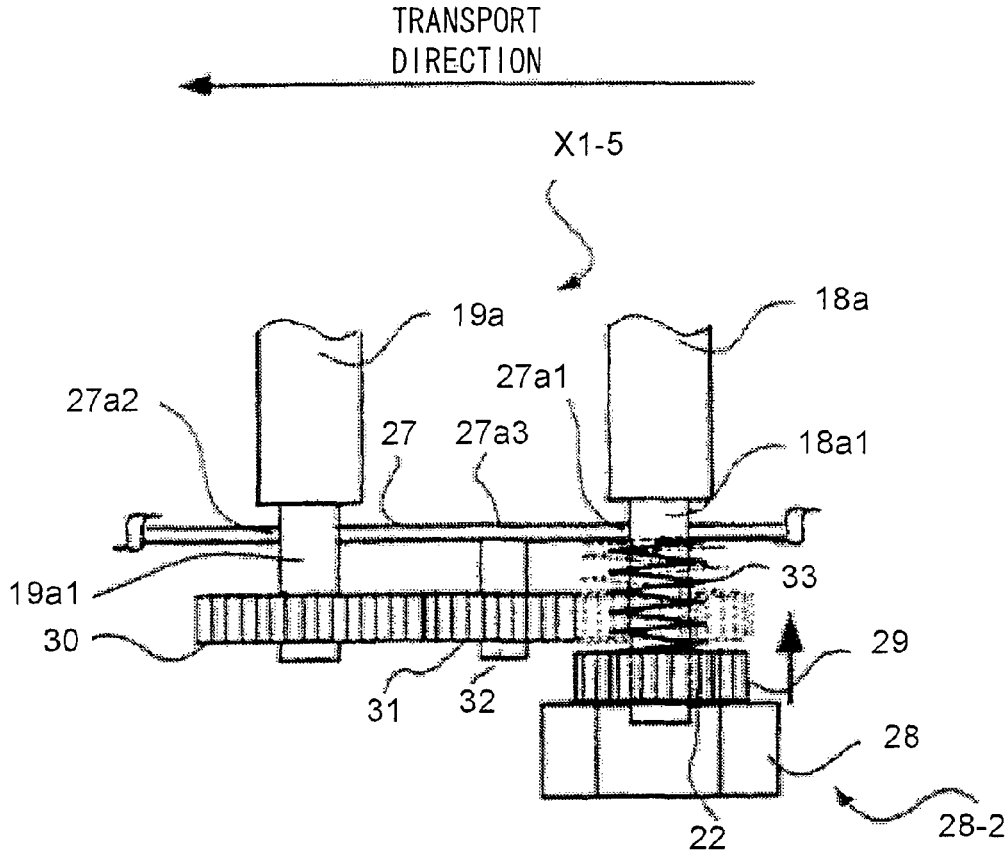
FIG. 7A is a schematic plan view of a sheet transporting apparatus X1-5, with the follow rollers 18*b* and 19*b* omitted from illustration.
Figure 7B:
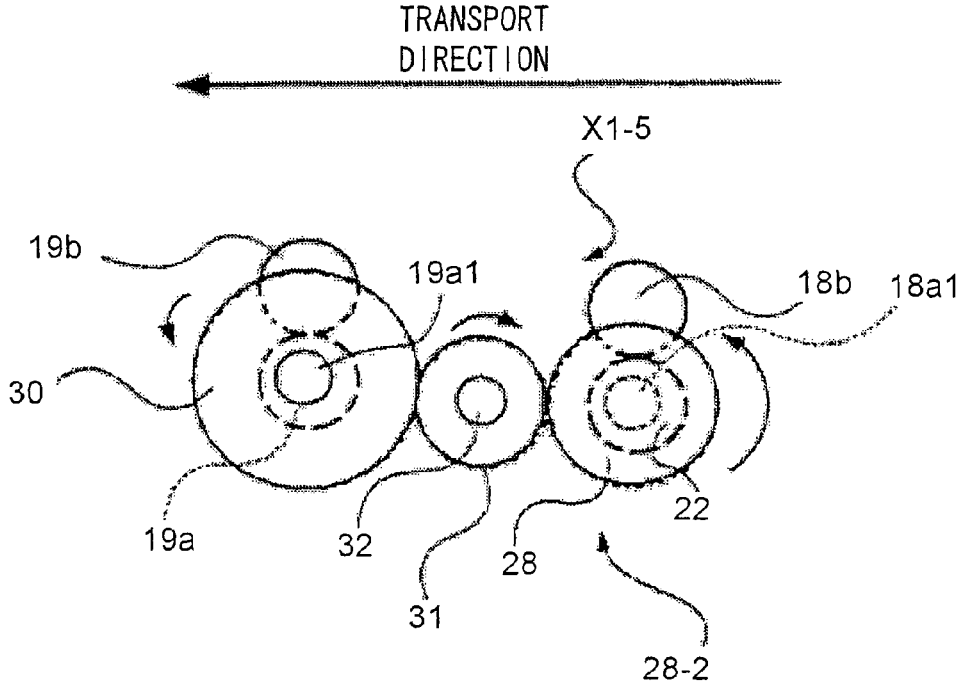
FIG. 7B is a schematic side view of the same, with the operation knob 28 (an example of a manual operation member) shown in FIG. 7A omitted from illustration.
Figure 8A:
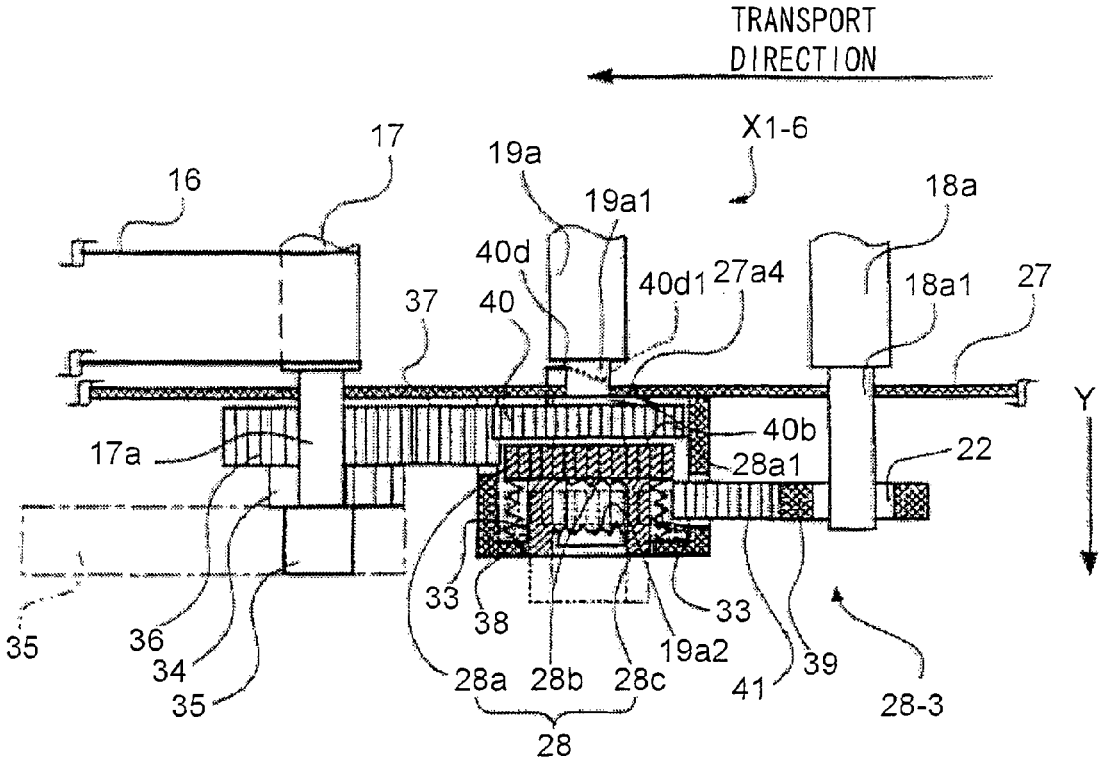
FIG. 8A is a schematic plan view of a sheet transporting apparatus X1-6 along with peripheral members of the transfer belt rotating roller 17, with the follow rollers 18*b* and 19*b* omitted from illustration.
Figure 8B:
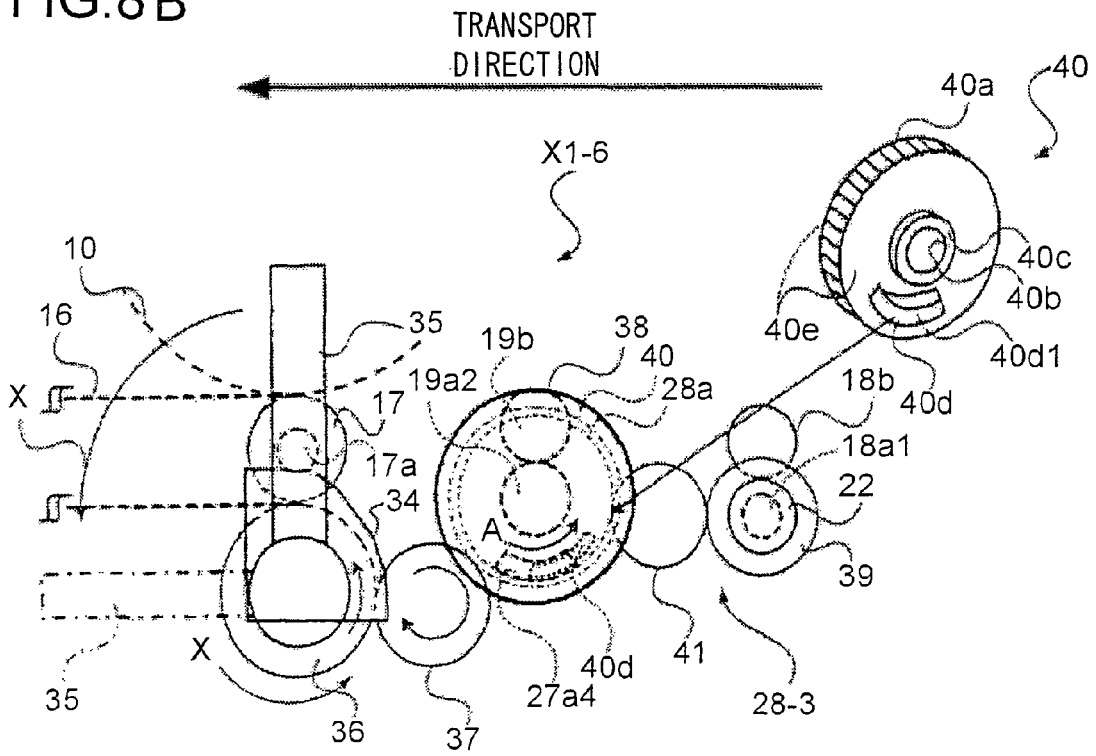
FIG. 8B is a schematic side view of the sheet transporting apparatus X1-6 shown in FIG. 8A.

Next, sheet transporting apparatuses X1 according to fourth to sixth embodiments will be described in detail with reference to FIGS. 5 to 8. FIG. 5 is a schematic side view in illustration of the workings and benefits of sheet transporting apparatuses X1 according to the fourth to sixth embodiments of the present invention; FIGS. 6A and 6B are a schematic plan view and a schematic side view, respectively, of a sheet transporting apparatus X1-1 according to the fourth embodiment; FIGS. 7A and 7B are a schematic plan view and a schematic side view, respectively, of a sheet transporting apparatus X1-2 according to the fifth embodiment; and FIGS. 8A and 8B are a schematic plan view and a schematic side view, respectively, of a sheet transporting apparatus X1-3 according to the sixth embodiment along with peripheral members of the transfer belt rotating roller 17.

In the sheet transporting apparatuses X1 according to the fourth to sixth embodiments, the circumferential speed V1 of a pair of transport rollers 18 is so set that it, when the pair of transport rollers 18 and a pair of resist rollers 19 rotate in the transport downstream direction of recording paper P through manual operation, is higher than the circumferential speed V2 of the pair of resist rollers 19. To achieve that, in the sheet transporting apparatuses X1, a manual operation unit 28-1, 2, or 3 is so structured as to make the pair of transport rollers 18 rotate at a circumferential speed higher than the circumferential speed at which the pair of resist rollers 19 rotates.

Thus the speed at which the recording paper P is transported in the transport downstream direction by the pair of transport rollers 18 is higher than the speed at which the recording paper P is transported in the transport downstream direction by the pair of resist rollers 19, and accordingly the amount of transport by which the recording paper P is transported by the pair of transport rollers 18 is larger than the amount of transport by which the recording paper P is transported by the pair of resist rollers 19. Consequently, as shown in FIG. 5, the recording paper P warps between the pair of transport rollers 18 and the pair of resist rollers 19 to form a pickup part as shown in FIG. 5 between the pair of transport rollers 18 and the pair of resist rollers 19, for example in a hollow-space portion provided by the upper transport guide 20*a* curved upward shown in FIG. 1. This makes it possible to hold and remove the recording paper P easily.

In the sheet transporting apparatuses X1 of the fourth to sixth embodiments, when the circumferential speed V1 of the pair of transport rollers 18 and the circumferential speed V2 of the pair of resist rollers 19 during manual operation of the manual operation unit 28-1, 2, or 3 are set, setting the transport speed of the pair of resist rollers 19 close to "0" makes the amount of transport of the recording paper P by the pair of resist rollers 19 close to "0". This, when a jammed sheet is transported through manual operation, makes a tip portion of the recording paper P less likely to enter the gap shown in FIG. 5 and also less likely to be caught inside the sheet transport path 21, and thus makes removal of the recording paper P easier.

Thus, even if, in the middle of an image forming process, a tip portion of the recording paper P enters the gap S and is caught inside the sheet transport path 21, causing a jam and stopping the transport of the recording paper P, it is possible, owing to the manual operation unit 28-1, 2, or 3, to form a pickup part in the recording paper P in the hollow-space portion between the pair of transport rollers 18 and the pair of resist rollers 19 without aggravating the jam of the recording paper P. This allows a user to hold the pickup part and remove the recording paper P easily.

Below will be described in detail, as specific examples of sheet transporting apparatuses applicable to the fourth to sixth embodiments, a sheet transporting apparatus X1-4 according to the fourth embodiment, a sheet transporting apparatus X1-5 according to the fifth embodiment, and a sheet transporting apparatus X1-6 according to the sixth embodiment one by one.

Fourth Embodiment

First, the sheet transporting apparatus X1-4 will be described with reference to FIGS. 6A and 6B. FIG. 6A is a schematic plan view of the sheet transporting apparatus X1-4, with the follow rollers 18*b* and 19*b* omitted from illustration, and FIG. 6B is a schematic side view of the sheet transporting apparatus X1-4, with the operation knob 28 (an example of a manual operation member) shown in FIG. 6A omitted from illustration. In this sheet transporting apparatus X1-4, the manual operation unit 28-1 is composed mainly of a pulley 24 (an example of an upstream-side rotating member), a pulley 25 (an example of a downstream-side rotating member), an operation knob 28 (an example of a manual operation member), a pulley belt 26 (an example of a rotation coupling member), and one-way clutches 22 and 23. The structure of the sheet transporting apparatus X1-4 provided with this manual operation unit 28-1 will now be described in detail.

In the sheet transporting apparatus X1-4, a shaft 18*a*1 (an example of an upstream-side transport roller shaft) of the drive roller 18*a* is rotatably mounted, via an unillustrated bearing, on a shaft support portion 27*a*1 provided in a side plate 27 integral with an unillustrated chassis. The upstream-side drive roller shaft 18*a*1 is fitted with, coaxially therewith and via a one-way clutch 22, an operation knob 28 integral with a pulley 24. The operation knob 28 may instead be fitted coaxially with a downstream-side drive roller shaft 19*a*1 (an example of a downstream-side transport roller shaft). This is because, in the sheet transporting apparatus X1-4, the manual operation unit 28-1 can be structured even with the operation knob 28 fitted coaxially with the downstream-side transport roller shaft 19*a*1.

On the other hand, in the sheet transporting apparatus X1-4, the downstream-side drive roller 19*a*1 is rotatably mounted, via an unillustrated bearing, on a shaft support portion 27*a*2 provided in the side plate 27. The downstream-side drive roller shaft 19*a*1 is fitted with a pulley 25 coaxially therewith and via a one-way clutch 23. A pulley belt 26 is wound around and between the pulleys 24 and 25, and the pulley ratio between the pulleys 24 and 25 is so set as to provide a circumferential speed ratio such that the circumferential speed V1 at which the pair of transport rollers 18 rotates by means of the manual operation unit 28-1 is higher than the circumferential speed V2 at which the pair of resist rollers 19 rotates. Thus, when recording paper is transported by means of the manual operation unit 28-1, a warped part is formed in the recording paper P between the pair of transport rollers 18 and the pair of resist rollers 19.

In this embodiment, the pulley ratio is set by making the pulley diameter of the pulley 24 smaller than the pulley diameter of the pulley 25. This is because, in the sheet transporting apparatus X1-4, as the circumferential speed V1 at which the pair of transport rollers 18 rotates by means of the manual operation unit 28-1, a circumferential speed is obtained that is higher than the circumferential speed V2 at which the pair of resist rollers 19 rotates by means of the manual operation unit 28-1.

In the sheet transporting apparatus X1-4, when, while the drive motors M1 and M2 are stationary, the operation knob 28 is rotated, and as a result the pulley 24 (the pulley integral with the operation knob 28) and the pulley 25, which are coupled with each other by the pulley belt 26, are both rotated in the transport downstream direction of the sheet (in FIG. 5, in the counter-clockwise direction), the one-way clutches 22 and 23 transmit only the rotation of the pulleys 24 and 25 in the transport downstream direction to the upstream-side and downstream-side drive roller shafts 18*a*1 and 19*a*1 to make the pair of transport rollers 18 and the pair of resist rollers 19 rotate in the transport downstream direction at the pulley ratio.

Here, "while the drive motors M1 and M2 are stationary" denotes a state in which, in the sheet transporting apparatus X1-4, the pair of transport rollers 18 and the pair of resist rollers 19 are decoupled from the drive motors M1 and M2 by separately provided clutches or the like and thus the pair of transport rollers 18 and the pair of resist rollers 19 are left freely rotatable. The one-way clutches 22 and 23 thus transmit rotation only in one direction; thus, during an image formation process, to prevent the rotation of the pair of transport rollers 18 and the pair of resist rollers 19 in the transport downstream direction from being transmitted to the operation knob 28, when the pulleys 24 and 25 are rotated in the reverse direction, that is, in the upstream direction with respect to the transport direction of the sheet (in FIG. 5B, in the clockwise direction), the rotation thereof is not transmitted to the upstream-side and downstream-side drive roller shafts 18*a*1 and 19*a*1, but the pulleys 24 and 25 rotate idly.

Specifically, in the sheet transporting apparatus X1-4, when a sheet is transported as a result of the drive motor M1 driving the upstream-side drive roller shaft 18*a*1 to rotate and the drive motor M2 driving the downstream-side drive roller shaft 19*a*1 to rotate, owing to the one-way clutches 22 and 23, the pulleys 24 and 25 rotate idly around the upstream-side and downstream-side drive roller shafts 18*a*1 and 19*a*1. This prevents the operation knob 28 from rotating, and in addition reduces the loads on the drive motors M1 and M2.

On the other hand, in a state where the drive motors M1 and M2 are stationary, when the operation knob 28, which is fitted coaxially with the upstream-side or downstream-side drive roller shaft 18*a*1 or 19*a*1, is rotated in the transport downstream direction of the sheet as described above, the upstream-side and downstream-side drive roller shafts 18*a*1 and 19*a*1 rotate simultaneously owing to the pulley belt 26 wound around and between the pulleys 24 and 25. This makes it possible to remove a jam occurring in the sheet transporting apparatus X1. Here, since the pulley ratio between the pulleys 24 and 25 is so set that the circumferential speed V1 at which the pair of transport rollers 18 rotates by means of the manual operation unit 28-1 is higher than the circumferential speed V2 at which the pair of resist rollers 19 rotates by means of the manual operation unit 28-1, it is possible to obtain the effect and benefit of making the recording paper P warp as described with reference to FIG. 5.

In the sheet transporting apparatus X1-4, it is also possible to make the roller diameter of the pair of transport rollers 18 larger than the roller diameter of the pair of resist rollers 19 to thereby make the circumferential speed at which the pair of transport rollers 18 rotates by means of the manual operation unit 28-1 higher than the circumferential speed at which the pair of resist rollers 19 rotates. Also in this case, it is possible to obtain the effect and benefit of making the recording paper P warp as shown in FIG. 5.

Fifth Embodiment

Next, the sheet transporting apparatus X1-5 will be described with reference to FIGS. 7A and 7B. FIG. 7A is a schematic plan view of the sheet transporting apparatus X1-5, with the follow rollers 18*b* and 19*b* omitted from illustration, and FIG. 7B is a schematic side view of the same with the operation knob 28 shown in FIG. 7A omitted from illustration. It is to be noted that such members as are found also in the sheet transporting apparatus X1-4 are identified by common reference signs, and no description thereof will be repeated.

In the sheet transporting apparatus X1-5, a manual operation unit 28-2 is composed mainly of a gear 29 (an example of an upstream-side rotating member), an idle gear 31, a gear 30 (an example of a downstream-side rotating member), an operation knob 28, and a one-way clutch 22 that transmits only the rotation of the gear 29 in the transport downstream direction to the upstream-side drive roller shaft 18*a*1. The gear ratio between the gears 29 and 30 is so set as to provide a circumferential speed ratio such that the circumferential speed at which the pair of transport rollers 18 rotates is higher than the circumferential speed at which the pair of resist rollers 19 rotates. This gear ratio is the ratio between the diameter of the gear on the upstream-side drive roller shaft 18*a*1 and the diameter of the gear on the downstream-side drive roller shaft 19*a*1, and thus can be varied by a user, as by interchanging the gears appropriately.

The structure of the sheet transporting apparatus X1-5 of this embodiment provided with this manual operation unit 28-2 will now be described in detail.

In the sheet transporting apparatus X1-5, during normal sheet transport (otherwise than during jam disposal), the operation knob 28 slidably fitted to the upstream-side drive roller shaft 18*a*1 integral with the drive roller 18*a* is constantly biased in a direction perpendicular to the side plate 27 and in a direction away from the side plate 27 by the elastic member 33; thus the gear 29 (an example of an upstream-side rotating member) integral with the operation knob 28 is in a state not meshed with an idle gear 31 (indicated by solid lines in FIG. 7A).

In this structure, during normal sheet transfer, the drive motor M1 drives the upstream-side drive roller shaft 18*a*1 to rotate, and in addition the drive motor M2 drives the downstream-side drive roller shaft 19*a*1 to rotate. However, even in a state where, by being driven by the drive motors M1 and M2, the upstream-side and downstream-side drive roller shafts 18*a*1 and 19*a*1 are rotating, during normal sheet transfer, as described above, the gear 29 integral with the operation knob 28 is in a state not meshed with the idle gear 31; thus, even when the upstream-side drive roller shaft 18*a*1 rotates and thus the operation knob 28 rotates, the rotation thereof is not transmitted to the downstream-side drive roller shaft 19*a*1 to which the operation knob 28 is not fitted.

Thus there is no need for a one-way clutch 23 as provided between the downstream-side drive roller shaft 19*a*1 and the pulley 25 in the sheet transporting apparatus X1-4 of the fourth embodiment. This makes it possible to achieve cost reduction, and also to reduce the load on the drive motor M1.

On the other hand, during jam disposal, when, while the drive motors M1 and M2 are stationary, the operation knob 28 is pushed in toward the side plate 27 as indicated by an arrow, the gear 29 integral with the operation knob 28 moves toward the side plate 27 against the biasing by the spring 33 and meshes with the idle gear 31 (indicated by broken lines in FIG. 7A). When, in this state, the operation knob 28 is rotated in the downstream direction (in FIG. 7B, in the counter-clockwise direction), the gear 29 rotates together in the same direction. Then the idle gear 31 rotates in the upstream direction with respect to the transfer direction (in FIG. 7B, in the counter-clockwise direction) and transmits the rotation of the gear 29 to the gear 30.

Thus, in a state where the drive motors M1 and M2 are stationary, by pushing the operation knob 28 in toward the side plate 27 and, in that state, rotating the operation knob 28 in the transport downstream direction, the gears 29 and 30 can be rotated in the transport downstream direction. Here, since the gear ratio between the gears 29 and 30 is so set as to provide a circumferential speed ratio such that the circumferential speed at which the pair of transport rollers 18 rotates is higher than the circumferential speed at which the pair of resist rollers 19 rotates, it is possible to obtain the effect and benefit of making the recording paper P warp as shown in FIG. 5.

By contrast, when the operation knob 28, while it is in a state pushed in toward the side plate 27, is rotated in the direction reverse to the transport direction, as described above, the one-way clutch 22 does not transmit the rotation of the gear 29 in the reverse direction to the upstream-side drive roller shaft 18*a*1, and thus the operation knob 28 rotates idly.

On the other hand, in a state where the operation knob 28 is pushed in toward the side plate 27, since the gear 29 and the idle gear 30 are meshed with each other, when the operation knob 28 is rotated in the reverse direction, the rotation thereof is transmitted to the downstream-side drive roller shaft 19*a*1. Thus, when the operation knob 28, while it is in a state pushed in toward the side plate 27, is rotated in the reverse direction, only the downstream-side drive roller shaft 19*a*1 can be rotated in the reverse direction while the upstream-side drive roller shaft 18*a*1 is kept stationary. Thus it is possible to make the recording paper P warp to form a pickup part between the pair of transport rollers 18 and the pair of resist rollers 19 as shown in FIG. 5, and thus a user can hold the pickup part and remove the sheet easily.

Also in the sheet transporting apparatus X1-5 according to the fifth embodiment, it is possible to make the roller diameter of the pair of transport rollers 18 larger than the roller diameter of the pair of resist rollers 19 to thereby make the circumferential speed of the pair of transport rollers 18 higher than the circumferential speed of the pair of resist rollers 19.

This makes it possible to obtain the effect and benefit of making the recording paper P warp as shown in FIG. 5.

Sixth Embodiment

Next, the sheet transporting apparatus X1-6 will be described with reference to FIGS. 8A and 8B. FIG. 8A is a schematic plan view of the sheet transporting apparatus X1-6 along with peripheral members of the transfer belt rotating roller 17, with the follow rollers 18*b* and 19*b* omitted from illustration, and FIG. 8B is a schematic side view of the sheet transporting apparatus X1-6 shown in FIG. 8A. It is to be noted that such members as are found also in the sheet transporting apparatuses X1-4 and X1-5 are identified by common reference signs, and no description thereof will be repeated.

In the sheet transporting apparatus X1-6, a manual operation unit 28-3 is composed mainly of a gear 39 (an example of an upstream-side rotating member), an idle gear 41, a gear portion 28*a* (an example of a downstream-side rotating member), a meshing surface 28*b*, a meshing tip portion 19*a*2, an operation knob 28, and a one-way clutch 22 that transmits only the rotation of the gear 39 in the transport downstream direction to the upstream-side drive roller shaft 18*a*1. The gear ratio between the gear portion 28*a* and the gear 39 is so set as to provide a circumferential speed ratio such that the circumferential speed at which the pair of transport rollers 18 rotates by means of the manual operation unit 28-3 is higher than the circumferential speed at which the pair of resist rollers 19 rotates. This gear ratio is the ratio between the diameter of the gear 39 on the upstream-side drive roller shaft 18*a*1 and the diameter of the gear 28*a* on the downstream-side drive roller shaft 19*a*1, and thus can be varied by a user, as by interchanging the gears appropriately. The structure of the sheet transporting apparatus X1-6 of this embodiment provided with this manual operation unit 28-3 will now be described in detail.

In the sheet transporting apparatus X1-6, the upstream-side drive roller shaft 18*a*1 is fitted, via the one-way clutch 22, with the gear 39, which is constantly in a state meshed with the idle gear 41. On the other hand, the downstream-side drive roller shaft 19*a*1 is fitted with an operation knob release gear 40 integrally therewith, and is also fitted with the operation knob 28, which is in contact with the operation knob release gear 40 via a boss portion 40*c* described later.

The operation knob 28, of which the entirety is hatched in FIG. 8A, is composed mainly of: a gear portion 28*a* having a contact surface 28*a*1 making contact with the operation knob release gear 40; a meshing surface 28*b* provided on the side of the gear portion 28*a* reverse to the contact surface 28*a*1 and having a plurality of claws formed in the shape of a ring thereon; and a knob portion 28*c* which a user can hold. In this operation knob 28, unillustrated insertion holes in the shape of splines are formed in the gear portion 28*a* and the meshing surface 28*b* so that, by means of those insertion holes, the operation knob 28 is fitted to the downstream-side drive roller shaft 19*a*1 so as to be slidable in the axial direction but not rotatable in relative terms.

A side plate 27 integral with an unillustrated chassis is fitted with a protection cover 38 in which the operation knob 28 can be housed, and, between the protection cover 38 and the gear portion 28*a*, an elastic member 33 such as a spring is fitted that has an elastic force biasing the gear portion 28*a* toward the side plate 27. During normal sheet transfer, as during an image forming process, the elastic member 33 biases the gear portion 28*a* toward the side plate 27. Thus the operation knob release gear 40 in contact with the gear portion 28*a* is, by being pressed by the gear portion 28*a*, also biased toward the side plate 27.

Accordingly, during normal sheet transfer, under the biasing by the elastic member 33, the operation knob 28 remains housed inside the protection cover 38 as indicated by solid lines. On the other hand, as will be described later, during jam processing, the operation knob 28 protrudes from the protection cover 38 in the frontward direction of the apparatus (in FIG. 8A, in the downward direction), and the structure involved will be described later.

Furthermore, in the sheet transporting apparatus X1-6, in a tip portion of the downstream-side drive roller shaft 19*a*1, a meshing tip portion 19*a*2 having a plurality of claws formed in the shape of a ring thereon that mesh with claws provided on the meshing surface 28*b* of the operation knob 28 is fixed opposite the meshing surface 28*b*. As will be described later, during jam disposal, when the operation knob 28 protrudes from the protection cover 38 in the frontward direction of the apparatus as indicated by dash-dot-dot lines, the meshing tip portion 19*a*2 meshes with the meshing surface 28*b* of the operation knob 28, and thereby couples the operation knob 28 and the downstream-side drive roller 19*a*1 with each other, so that the rotation of the operation knob 28 is transmitted to the downstream-side drive roller 19*a*1.

On the other hand, on the downstream side relative to the downstream-side drive roller shaft 19*a*1, a structure for attaching/detaching the transfer belt rotating roller 17 and the photoconductive drum 10 to/from each other is provided. As shown in FIGS. 8A and 8B, this structure is provided with: a cam 34 in contact with a transfer belt rotating roller shaft 17*a*; an operation knob release lever 35 integral with the cam 34; a gear 36; and an idle gear 37 meshed with the gear 36.

The operation knob release gear 40 is composed mainly of: a gear portion 40*a* on the outer circumference; an insertion hole 40*b* in which the downstream-side drive roller shaft 19*a*1 is inserted so as to be rotatable in relative terms; a boss portion 40*c* formed integrally around the insertion hole 40*b*; and an arc-shaped projection 40*d* formed in the side plate 27 and inserted in a projection insertion hole 27*a*4 in the shape of an arc about the insertion hole 40*b*. The boss portion 40*c* is formed on each of the obverse and reverse sides of the operation knob release gear 40; an end face of the boss portion 40*c* on one side portion 40*e* makes contact with the side plate 27, and an end face of the other boss portion 40*c* is constantly in contact with a side face of the gear portion 28*a* of the operation knob 28. Moreover, on an end face of the projection 40*d*, a slanted portion 40*d*1 having a tapered shape is formed. Thus, the projection 40*d* rotates together with the operation knob release gear 40.

In the sheet transporting apparatus X1-6, owing to the operation knob release gear 40 structured as described above, during jam disposal or the like, when the upstream-side drive roller 18*a* and the downstream-side drive roller 19*a* are decoupled from the drive motors M1 and M2, as the transfer belt drive roller 17 and the photoconductive drum 10 are detached from each other, the following effects are obtained. Specifically, in the sheet transporting apparatus X1-6, when the operation knob release lever 35 is rotated in the direction of arrow X in FIG. 8B so that the transfer belt rotating roller 17 are detached from the photoconductive drum 10, the gear 36 fitted to the operation knob release lever 35 rotates in the same direction, and thus the rotation of the gear 36 is transmitted via the idle gear 37 to the operation knob release gear 40.

Thus, the projection 40*d* fixed to the operation knob release gear 40 rotates together, and the slanted portion 40*d*1 of the projection 40*d* rotates while in contact with an edge portion of the projection insertion hole 27*a*4 of the side plate 27; thus, owing to the wedge effect of the slanted portion 40*d*1, the projection 40*d* and the operation knob release gear 40 integral therewith rotate in a direction away from the side plate 27 (in FIG. 8A, in the direction of arrow Y). Thus the operation knob release gear 40 and the operation knob 28, which includes the gear portion 28*a* in contact with the operation knob release gear 40 via the boss portion 40*c*, are coupled to each other.

At this time, having moved as described above, the gear portion 28*a* of the operation knob 28 meshes, as shown in FIG. 8A, with the idle gear 41 from which it has thus far been detached. As a result, when the operation knob 28 is rotated manually, the rotation thereof is transmitted via the gear portion 28*a*, the meshing tip portion 19*a*2, and the downstream-side drive roller shaft 19*a*1 to the downstream-side drive roller 19*a*, and is also transmitted via the gear portion 28*a*, the idle gear 41, the gear 39, the one-way clutch 22, and the upstream-side drive roller shaft 18*a*1 to the upstream-side drive roller 18*a*. Thus, by rotating the operation knob 28 manually in the direction of arrow A in FIG. 8A, the upstream-side drive roller 18*a* and the downstream-side drive roller 19*a* rotate; thus it is possible to transport the sheet in the transport downstream direction.

On the other hand, when the operation knob release lever 35 is rotated in the direction reverse to the direction of arrow X, the gear 36 fitted to the operation knob release lever 35 rotates in the reverse direction, and thus the rotation of the gear 36 in the reverse direction is transmitted via the idle gear 37 to the operation knob release gear 40. Thus, owing to the wedge effect of the slanted portion 40*d*1, the gear portion 28*a* (and the operation knob 28) biased by the elastic member 33 moves in the direction reverse to the direction of arrow Y; thus the gear portion 28*a* and the idle gear 41 unmesh from each other, and the meshing surface 28*b* and the meshing tip portion 19*a*2 unmesh from each other. Thus, even when the operation knob 28 is rotated, neither the upstream-side drive roller 18*a* nor the downstream-side drive roller 19*a* rotate; thus it is now impossible to transport the sheet in contact with the upstream-side drive roller 18*a* and the downstream-side drive roller 19*a*.

Here, the gear ratio between the gear portion 28*a* and the gear 39 is so set as to provide a circumferential speed ratio such that the circumferential speed at which the pair of transport rollers 18 rotates by means of the manual operation unit 28-3 is higher than the circumferential speed at which the pair of resist rollers 19 rotates by means of the manual operation unit 28-3. Thus it is possible to obtain the effect and benefit of forming a warped part in the recording paper P in the hollow-space portion on the transport path as shown in FIG. 5.

On the other hand, in the sheet transporting apparatus X1-6, during normal sheet transfer, as during an image forming process, the drive motor M1 drives the upstream-side drive roller shaft 18*a*1 to rotate and in addition the drive motor M2 drives the downstream-side drive roller shaft 19*a*1 to rotate. Meanwhile, since the transfer belt rotating roller 17 are in the position indicted by solid lines in FIG. 8B where they make contact with the photoconductive drum 10 via the transfer belt 16, and thus the projection 40*d* is in the position shown in FIG. 8A, and since the operation knob 28 in contact with the operation knob release gear 40 is in the position indicated by solid lines in FIG. 8A by being biased by the elastic member 33, the operation knob release lever 35 is disconnected from the downstream-side drive roller shaft 19*a*1 and rotates idly. On the other hand, since the gear portion 28*a* and the idle gear 41 are not meshed with each other, the gear 39 rotates idly. This makes it possible to reduce the loads on the drive motors M1 and M2.

Simultaneously, the rotation of the operation knob 28 is transmitted also to the idle gear 41, and the rotation of the idle gear 41 is transmitted to the gear 39; thus the gear 39 rotates in the transport downward direction of the gear 39 (in FIG. 8B, in the counter-clockwise direction). Thus, when the operation knob 28 is rotated in the transport downward direction of the operation knob 28 (in FIG. 8B, in the counter-clockwise direction), the pair of transport rollers 18 and the pair of resist rollers 19 rotate in the transport downward direction thereof (in FIG. 8B, in the counter-clockwise direction).

On the other hand, when, in a state where the operation knob 28 is coupled with the downstream-side drive roller shaft 19*a*1 and with the gear 39, the operation knob 28 is rotated in the reverse direction (i.e., in the upstream direction of the operation knob 28 with respect to the transport direction), the rotation thereof is transmitted to the downstream-side drive roller shaft 19*a*1 and to the gear 39, but, owing to the function of the one-way clutch 22, is not transmitted to the upstream-side drive roller shaft 18*a*1. Thus, also by rotating the operation knob 28 in the reverse direction and thereby rotating only the downstream-side drive roller shaft 19*a*1 in the upstream direction thereof, it is possible to make the sheet warp between the pair of transport rollers 18 and the pair of resist rollers 19 and remove the sheet.

Also in the sheet transporting apparatus X1-6, it is possible to make the roller diameter of the pair of transport rollers 18 larger than the roller diameter of the pair of resist rollers 19 to thereby make the circumferential speed at which the pair of transport rollers 18 rotates by means of the manual operation unit 28-3 higher than the circumferential speed of the pair of resist rollers 19. This makes it possible to obtain the effect and benefit of forming a warped part in the recording paper P in the hollow-space portion on the transport path as shown in FIG. 5.

What is claimed is:

1. A sheet transporting apparatus that transports a sheet by rotating, with drive motors, an upstream-side transport roller provided at an upstream side with respect to a sheet transport direction and a downstream-side transport roller provided at a downstream side with respect to the sheet transport direction, the sheet transporting apparatus comprising:

a manual operation unit that is fitted coaxially with a roller shaft of the upstream-side transport roller or with a roller shaft of the downstream-side transport roller and that, when rotated in a state where the drive motors are stationary, makes the upstream-side transport roller shaft and the downstream-side transport roller shaft rotate; and a slide mechanism that allows the manual operation unit to slide in an axial direction of the upstream-side transport roller shaft or of the downstream-side transport roller shaft.

2. The sheet transporting apparatus according to claim 1, wherein the slide mechanism switches whether or not rotation of the manual operation unit is transmitted to the roller shaft to which the manual operation unit is not fitted.

3. The sheet transporting apparatus according to claim 1, further comprising:

an attaching/detaching unit that attaches and detaches, to and from an image carrying member on which an output image is formed, or to and from a transfer destination member onto which the output image on the image carrying member is transferred, a transfer unit that transfers the output image onto the sheet, wherein, when the attaching/detaching unit detaches the transfer unit from the image carrying member or from the transfer destination member, the slide mechanism makes the manual operation unit slide in a direction away from the upstream-side and downstream-side transport rollers along the roller shafts thereof.

4. A sheet transporting apparatus that transports a sheet by rotating, with drive motors, an upstream-side transport roller provided at an upstream side with respect to a sheet transport direction and a downstream-side transport roller provided at a downstream side with respect to the sheet transport direction, the sheet transporting apparatus comprising:

a manual operation unit that is fitted coaxially with a roller shaft of the upstream-side transport roller or with a roller shaft of the downstream-side transport roller and that, when rotated in a state where the drive motors are stationary, makes the upstream-side transport roller shaft and the downstream-side transport roller shaft rotate; and a reverse rotation mechanism that, when the manual operation unit is rotated in a reverse direction, transmits rotation thereof only to the downstream-side transport roller shaft to move the sheet to an upstream side.

5. The sheet transporting apparatus according to claim 1, wherein, between the manual operation unit and the upstream-side transport roller shaft or the downstream-side transport roller shaft, a one-way clutch is interposed that transmits only rotation that moves the sheet in a downstream direction.

6. A sheet transporting apparatus that transports a sheet by rotating, with drive motors, an upstream-side transport roller provided at an upstream side with respect to a sheet transport direction and a downstream-side transport roller provided at a downstream side with respect to the sheet transport direction, the sheet transporting apparatus comprising:

a manual operation unit that is fitted coaxially with a roller shaft of the upstream-side transport roller or with a roller shaft of the downstream-side transport roller and that, when rotated in a state where the drive motors are stationary, makes the upstream-side transport roller shaft and the downstream-side transport roller shaft rotate, wherein a circumferential speed of rotation of the upstream-side transport roller by the manual operation unit is set to be higher than a circumferential speed of rotation of the downstream-side transport roller.

7. The sheet transporting apparatus according to claim 6, wherein the manual operation unit comprises upstream-side and downstream-side rotating members comprising pulleys, and a difference between the circumferential speeds is set by a ratio of the pulleys.

8. The sheet transporting apparatus according to claim 6, wherein the manual operation unit comprises upstream-side and downstream-side rotating members comprising gears, and a difference between the circumferential speeds is set by a ratio of the gears.

9. The sheet transporting apparatus according to claim 6, wherein a diameter of the upstream-side transport roller is set larger than a diameter of the downstream-side transport roller.

10. The sheet transporting apparatus according to claim 6, wherein, on a transport path between the upstream-side and downstream-side transport rollers, a hollow-space portion is provided to allow removal of a sheet warped owing to a difference between the circumferential speeds.

11. The sheet transporting apparatus according to claim 6, wherein the downstream-side transport roller is provided at an upstream side with respect to a transfer unit that transfers the output image onto the sheet.

12. The sheet transporting apparatus according to claim 6, further comprising:

a slide mechanism that allows the manual operation unit to slide in an axial direction of the upstream-side transport roller shaft or of the downstream-side transport roller shaft.

13. The sheet transporting apparatus according to claim 1, further comprising:

a reverse rotation mechanism that, when the manual operation unit is rotated in a reverse direction, transmits rotation thereof only to the downstream-side transport roller shaft to move the sheet to an upstream side.

* * * * *